US007357113B2

(12) United States Patent
Obayashi et al.

(10) Patent No.: US 7,357,113 B2
(45) Date of Patent: Apr. 15, 2008

(54) BAFFLE PLATE CONFIGURATION OF INTERNAL COMBUSTION ENGINE

(75) Inventors: Toru Obayashi, Toyokawa (JP); Hiroaki Kawahara, Toyota (JP); Toshiyuki Goto, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 11/485,311

(22) Filed: Jul. 13, 2006

(65) Prior Publication Data

US 2007/0028886 A1 Feb. 8, 2007

(30) Foreign Application Priority Data

Aug. 3, 2005 (JP) ..... 2005-225250

(51) Int. Cl.
*F02F 7/00* (2006.01)
*F01M 11/00* (2006.01)

(52) U.S. Cl. ..... 123/196 R; 123/195 C

(58) Field of Classification Search ..... 123/195 C, 123/196 R; 184/106
See application file for complete search history.

(56) References Cited

U.S. PATENT DOCUMENTS 3,101,129 A * 8/1963 Hulten ..... 184/106
4,909,203 A * 3/1990 Fukuo ..... 123/196 R
5,452,692 A * 9/1995 Spray et al. ..... 123/195 C

FOREIGN PATENT DOCUMENTS

| | | |
|---|---|---|
| JP | 5-7917 | 2/1993 |
| JP | 2001-98916 | 4/2001 |
| JP | 2004-293307 | 10/2004 |

* cited by examiner

*Primary Examiner*—Stephen K. Cronin
*Assistant Examiner*—Hyder Ali
(74) *Attorney, Agent, or Firm*—Oblon, Spivak, McClelland, Maier & Neustadt, P.C.

(57) ABSTRACT

A baffle plate configuration of an internal combustion engine according to a first embodiment of the invention is provided below a rotational member arranged on or near a crankshaft and prevents the rotational members and lubricant in a pan from interfering each other. The baffle plate includes a preventing portion that is provided at an end portion of the baffle plate located in the side that is opposite, in the axial direction of the crankshaft, to the side where a larger amount of lubricant returns to the pan. The preventing portion prevents piston pumping air generated above the baffle plate from entering a space below the baffle plate through the end portion of the baffle plate.

19 Claims, 4 Drawing Sheets

BAFFLE PLATE CONFIGURATION OF INTERNAL COMBUSTION ENGINE

INCORPORATION BY REFERENCE

The disclosure of Japanese Patent Application No. 2005-225250 filed on Aug. 3, 2005 including the specification, drawings and abstract is incorporated herein by reference in its entirety.

BACKGROUND OF THE INVENTION

1. Field of the Invention

The invention generally relates to a baffle plate configuration of an internal combustion engine, more particularly, to a baffle plate configuration of an internal combustion engine that prevents adverse effects on a flow of lubricant in a pan caused by piston pumping air generated above the baffle plate.

2. Description of the Related Art

A technology in which a baffle plate is provided to separate rotational members arranged on or near a crankshaft, for example, connecting rods, from lubricant in a pan is disclosed in Japanese Utility Model Application Publication No. JP-U-5-7917. It is an object of the technology to prevent the rotational members and lubricant from interfering each other.

Piston pumping air (that is, blowby gas) generated above the baffle plate tends to enter the pan through the end of the baffle plate in one side of the crankshaft in the axial direction thereof, which is opposite to the other side where, owing to some structural reason such as a timing chain being provided therein, a large amount of lubricant returns to the pan. This tendency becomes stronger as the displacement of the internal combustion engine becomes larger, because the amount of piston pumping air accordingly increases. In this case, the lubricant that is returning to the pan through the baffle plate in the one side of the crankshaft collides with the piston pumping air that is entering the pan through the baffle plate in the other side of the crankshaft. Therefore, the lubricant cannot smoothly return to the pan.

Further, in terms of protection of pedestrians and arrangement of accessories, it is preferable that the overall height of an engine be reduced by reducing the height of the shallow depth portion of a pan. However, when the overall height of the engine is thus reduced, it is more likely that lubricant returning to the pan through the baffle plate in the one side of the crankshaft collides with piston pumping air entering the pan through the baffle plate in the other side of the crankshaft. In consideration of this, a technology that enables lubricant to return smoothly to the pan has been desired.

Moreover, when piston pumping air enters the pan through the baffle plate in the other side of the crankshaft, the following problems, for example, arise: (1) lubricant is further quickly deteriorated as a result of being stirred by the piston pumping air entering the pan; (ii) the temperature of the lubricant increases; (iii) the amount of lubricant that is atomized by the collision between lubricant and piston pumping air and then taken away by the piston pumping air increases; and (iv) the ratio of air bubbles in lubricant increases.

SUMMARY OF THE INVENTION

A baffle plate configuration of an internal combustion engine according to a first aspect of the invention is provided below a rotational member arranged on or near a crankshaft and includes a baffle plate for preventing interference between the rotational members and lubricant in a pan. The baffle plate configuration also includes a preventing portion that is provided at an end portion of the baffle plate located in the side that is opposite, in the axial direction of the crankshaft, to the side where a larger amount of lubricant returns to the pan, and that prevents piston pumping air generated above the baffle plate from entering the space below the baffle plate through the end portion of the baffle plate.

According to this structure, piston pumping air generated above the baffle plate is prevented from entering the space below the baffle plate through the end portion thereof located in the side that is opposite, in the axial direction of the crankshaft, to the side where a larger amount of lubricant returns to the pan. As a result, collisions between lubricant returning to the pan through the baffle plate from the side of a larger amount of returning lubricant and piston pumping air entering the pan through the baffle plate from the opposite side can be prevented, so that the lubricant can smoothly return to the pan.

Further, since collisions between lubricant and piston pumping air can be prevented as described above, it is possible to reduce the height of a shallow depth portion of the pan and thus the overall height of the engine, which is significantly desirable and advantageous in view of the protection of pedestrians and arrangement of accessories, for example. Moreover, since piston pumping air is prevented from entering the pan as described above, lubricant is not stirred by piston pumping air. This suppresses deterioration of lubricant and an increase of the temperature of lubricant. In addition, the amount of lubricant which is atomized due to collision with piston pumping air and then carried away by the piston pumping air is reduced. Also, the ratio of air bubbles contained in lubricant can be reduced.

A baffle plate configuration of an internal combustion engine according to a second aspect of the invention prevents a rotational member arranged on or near a crankshaft and lubricant in a pan from interfering each other. The baffle plate configuration includes a chain that is provided at an end portion of the crankshaft located in one side in the axial direction of the crankshaft and transmits rotation of the crankshaft. The baffle plate configuration further includes a preventing portion that is provided at an end portion of the baffle plate located in the side that is opposite, in the axial direction of the crankshaft, to the side where the chain is provided, and that prevents piston pumping air generated above the baffle plate from entering the space below the baffle plate through the end portion of the baffle plate.

According to this structure, piston pumping air generated above the baffle plate is prevented from entering the space below the baffle plate through the end portion thereof located in the side that is opposite, in the axial direction of the crank shaft, to the side where the chain that transmits rotation of the crankshaft is provided. As a result, lubricant returning to the pan through the baffle plate from the side where the chain is provided is prevented from colliding with piston pumping air entering the pan through the baffle plate from the opposite side, so that the lubricant can smoothly return to the pan.

Further, since collisions between lubricant and piston pumping air can be prevented as described above, it is possible to reduce the height of a shallow depth portion of the pan and thus the overall height of the engine, which is significantly desirable and advantageous in view of the protection of pedestrians and arrangement of accessories, for example. Moreover, since piston pumping air is prevented from entering the pan as described above, lubricant is not stirred by piston pumping air. This suppresses deterioration of lubricant and an increase of the temperature of lubricant. In addition, the amount of lubricant which is atomized due to collision with piston pumping air and then carried away by the piston pumping air is reduced. Also, the ratio of air bubbles contained in lubricant can be reduced.

A baffle plate configuration of an internal combustion engine according to a third aspect of the invention prevents a rotational member arranged on or near a crankshaft and lubricant in a pan from interfering each other. The baffle plate configuration includes a shallow depth portion that is formed in one side in the axial direction of the crankshaft and has a shallow depth. The baffle plate configuration includes a preventing portion that is provided at an end portion of the baffle plate located in the side that is opposite, in the axial direction of the crankshaft, to the side where the shallow depth portion is provided, and that prevents piston pumping air generated above the baffle plate from entering the space below the baffle plate through the end portion of the baffle plate.

According to this structure, piston pumping air generated above the baffle plate is prevented from entering the space below the baffle plate through the end portion thereof located in the side that is opposite, in the axial direction of the crank shaft, to the side where the shallow depth portion is provided. As a result, lubricant returning to the pan through the baffle plate and the shallow depth portion is prevented from colliding with piston pumping air entering the pan through the baffle plate from the opposite side, so that the lubricant can smoothly return to the pan.

Further, since collisions between lubricant and piston pumping air can be prevented as described above, it is possible to reduce the height of the shallow depth portion of the pan and thus the overall height of the engine, which is significantly desirable and advantageous in view of the protection of pedestrians and arrangement of accessories, for example. Moreover, since piston pumping air is prevented from entering the pan as described above, lubricant is not stirred by piston pumping air. This suppresses deterioration of lubricant and an increase of the temperature of lubricant. In addition, the amount of lubricant which is atomized due to collision with piston pumping air and then carried away by the piston pumping air is reduced. Also, the ratio of air bubbles contained in lubricant can be reduced.

A baffle plate configuration of an internal combustion engine according to a fourth aspect of the invention is provided below a rotational member arranged on or near a crankshaft, and prevents the rotational member and lubricant in a pan from interfering each other. The baffle plate includes a preventing portion that is provided at an end portion of the baffle plate located in the side that is opposite, in the axial direction of the crank shaft, to the side where the crankshaft protrudes from a crankcase that houses the rotational member, and that prevents piston pumping air generated above the baffle plate from entering the space below the baffle plate through the end portion of the baffle plate.

BRIEF DESCRIPTION OF THE DRAWINGS

The foregoing and/or further objects, features and advantages of the invention will become more apparent from the following description of preferred embodiment with reference to the accompanying drawings, in which like numerals are used to represent like elements and wherein.

DETAILED DESCRIPTION OF THE PREFERRED EMBODIMENTS

In the following description, the invention will be described in more detail in terms of exemplary embodiments.

Figure 1:
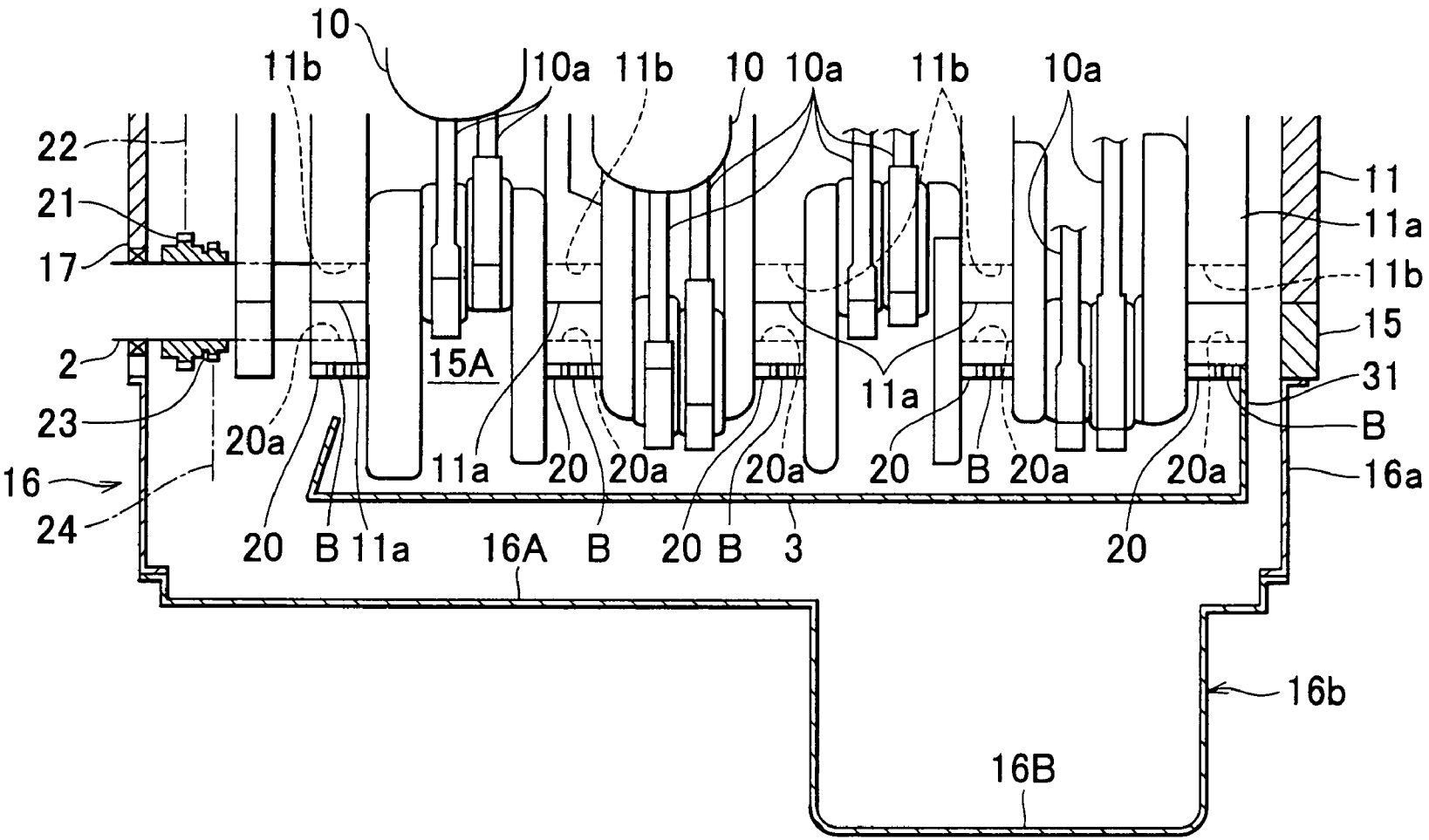
FIG. 1 is a cross-sectional view in which a lower portion of a V-engine according to an embodiment of the invention is viewed from a side of a vehicle.
Figure 2:
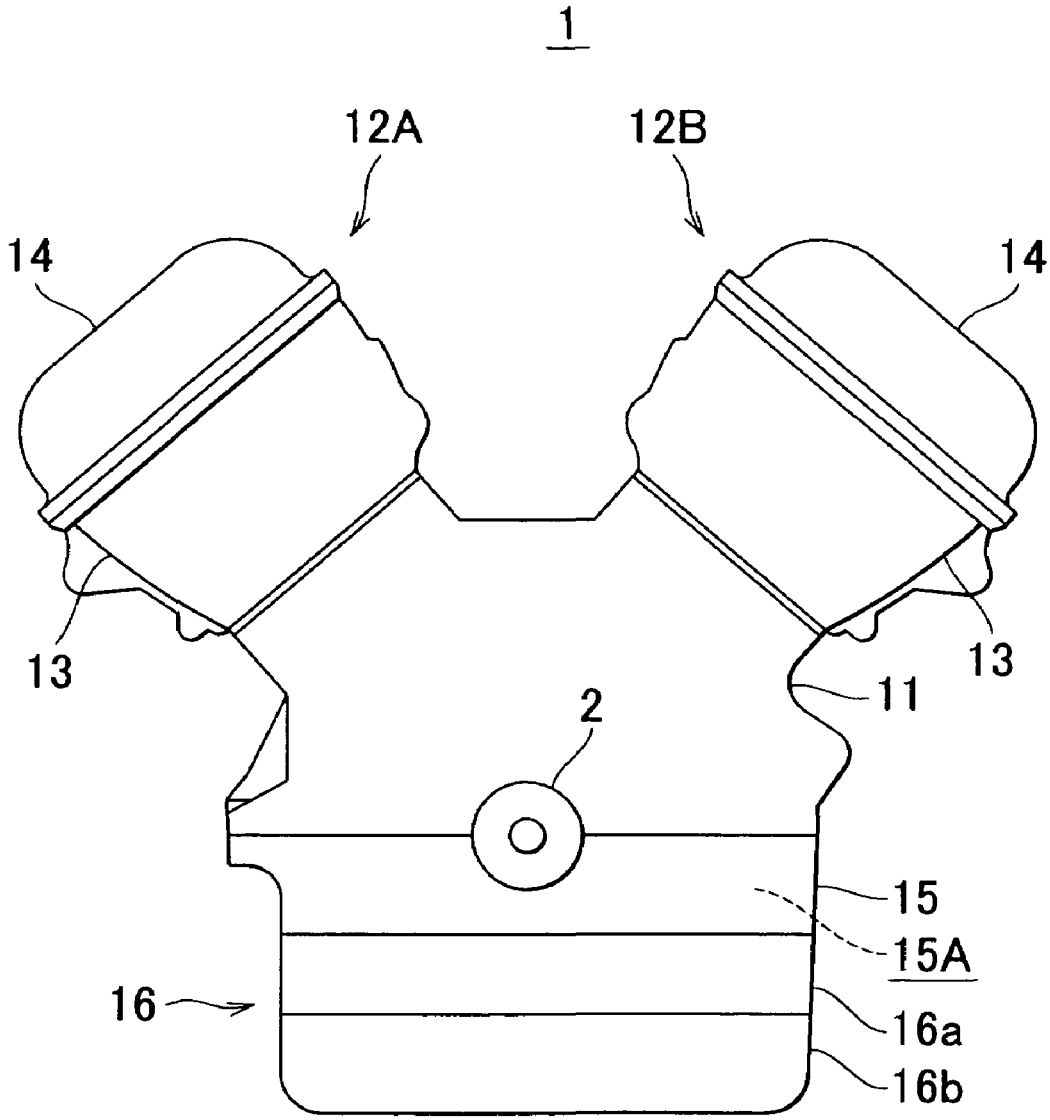
FIG. 2 is a front view in which the V-engine is viewed from a front side in an axial direction of a crankshaft.

FIG. 1 is a cross-sectional view of a lower portion of a V-engine 1 as an internal combustion engine to which a baffle plate configuration according to the invention is applied. FIG. 1 is viewed from the side that is parallel to the axis of a crankshaft 2. FIG. 2 is a front view in which the V-engine 1 is viewed in the axial direction of the crankshaft 2.

As shown in FIG. 2, the V-engine 1 includes banks 12A and 12B that protrude upward from a cylinder block 11 to form a V shape. The banks 12A and 12B includes cylinder heads 13, 13 that are provided on the cylinder block 11, and head covers 14, 14 that are fixed at the upper ends of the cylinder heads 13, 13, respectively. Four cylinders are provided at a predetermined cylinder angle in each of the banks 12A, 12B. As shown in FIG. 1, each of pistons 10 (FIG. 1 shows only two of the pistons 10) is drivingly connected to the crankshaft 2 though connecting rods (rotational members) 10*a*. As shown in FIG. 2, a crankcase 15 is provided below the cylinder block 11, and a crank chamber 15A is defined by a space inside the crankcase 15. In this case, the gas that leaks from a gap between the cylinders and the pistons becomes blowby gas in the crank chamber 15A. This blowby gas and the pumping air generated by vertical movement of the pistons flow toward the front of the V-engine 1, because the inside space of the V-engine 1 is closed in the rear.

In the crank chamber 15A, crank journal supports 11*a* are formed at the lower ends of the cylinder block 11 at predetermined intervals in the axial direction of the crankshaft 2. The lower surface of each of the crank journal support 11*a* which is formed concave and thus has a semi-arc shape in cross section provides a concave portion 11*b*. Further, a crank cap 20 that has a concave portion 20*a* with a semi-arc shape in cross section is fixed to the lower face of each of the crank journal supports 11*a* with a bolt B. The crankshaft 2 is rotatably supported between the concave portions 11*b* of the crank journal supports 11*a* and the concave portions 20*a* of the crank caps 20.

A pan 16 that serves as a sump is provided below the crankcase 15. The pan 16 is divided into an upper pan 16*a*, which is fixed to the lower end of the crankcase 15, and a lower pan 16*b*, which is fixed to the lower end of the upper pan 16*a*. A shallow depth portion 16A is provided in a front portion of the lower pan 16*b*. A deep depth portion 16B is provided in a rear portion of the lower pan 16*b* to store lubricant that returns to the pan 16. In this construction, the upper pan 16*a* is made of aluminum alloy, and the lower pan 16*b* is formed by pressing an iron plate. It should be noted, however, that materials used to form the upper pan 16*a* and the lower pan 16*b* are not limited to the combination described herein, and both of the upper and lower pans may be formed using the same material. Further, a pan made of magnesium alloy or the like may be used in combination of the upper and lower pans.

As shown in FIG. 1, in the front side of the crankshaft 2 (the left in FIG. 1), the crankshaft 2 protrudes forward past the front ends of the cylinder block 11 and the crankcase 15. A first crank sprocket 21 is coupled to the protruding portion of the crankshaft 2 so that they rotate together. A cam sprocket (not shown) is coupled to one end of a camshaft in each cylinder head 13 of each bank 12A and 12B so that the cam sprocket and the cam shaft rotate together. A timing chain 22 (chain) is wound around the first crank sprocket 21 and the cam sprockets. The first crank sprocket 21 rotates so that the cam sprockets are driven. Further, a second crank sprocket 23 is also coupled to the protruding portion of the crankshaft 2 so that they rotate together. The second crank sprocket 23 is located further to the crankcase 15 side (the right in FIG. 1) than is the first crank sprocket 21. A pump drive chain 24 is wound around the second crank sprocket 23 and a pump sprocket of the pump. The pump is driven by the pump sprocket being rotated by rotation of the second crank sprocket 23. In the front of the cylinder heads 13, the cylinder block 11, and the crankcase 15, a timing chain cover 17 made of aluminum alloy is attached to an upper edge of the front end of the upper pan 16*a* so that the timing chain 22 and the pump drive chain 24, which are located further forward than the front ends of the cylinder block 11 and the crankcase 15, are covered by the timing chain cover 17.

The front end of the crankshaft 2 is located further forward than the timing chain cover 17. A crankshaft pulley for driving accessories is also coupled to the front end of the crankshaft 2 so that the crankshaft pulley rotates together with the crankshaft 2.

Figure 3:
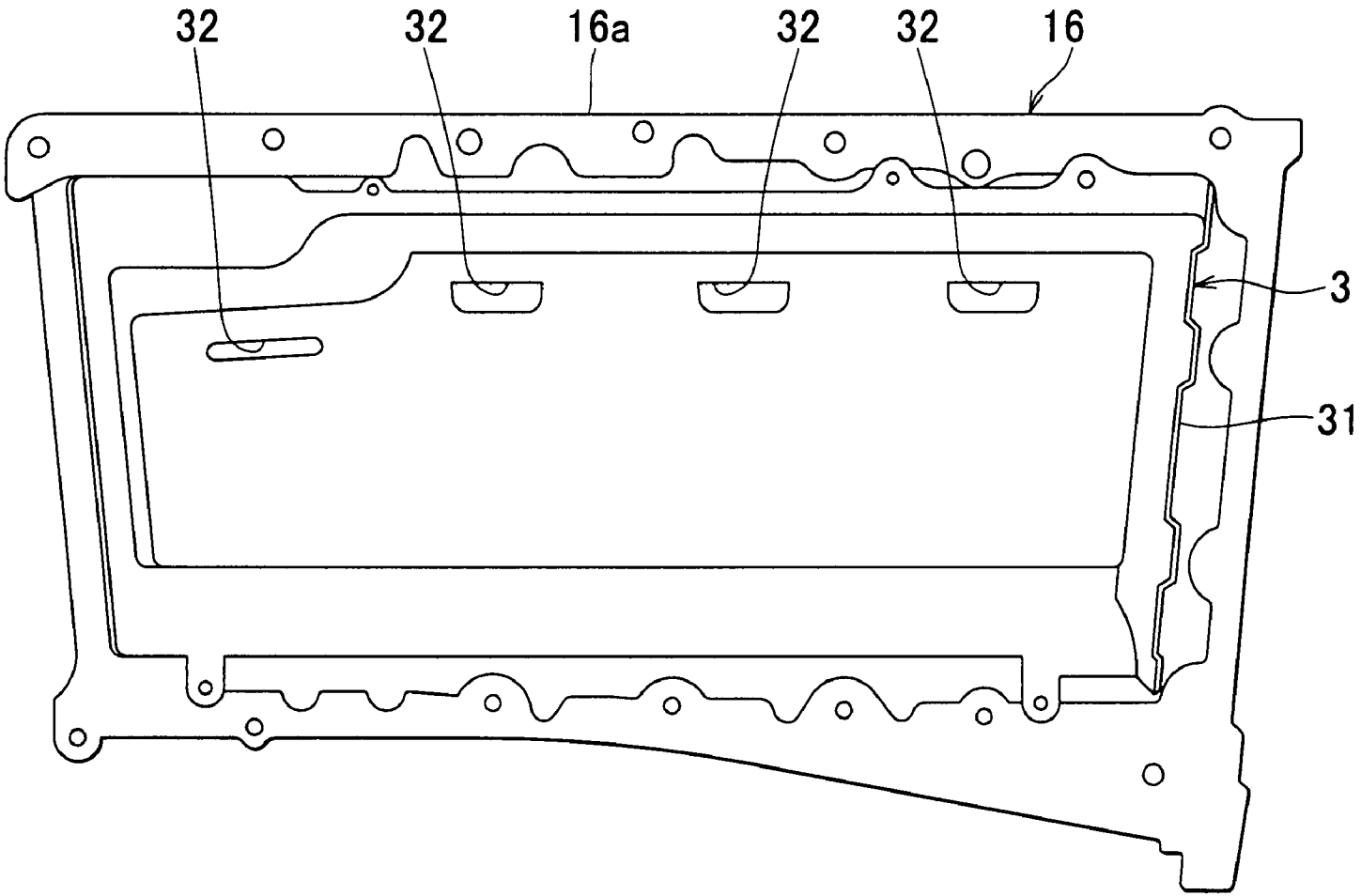
FIG. 3 is a plan view of a baffle plate that is attached to a pan viewed from above.
Figure 4:
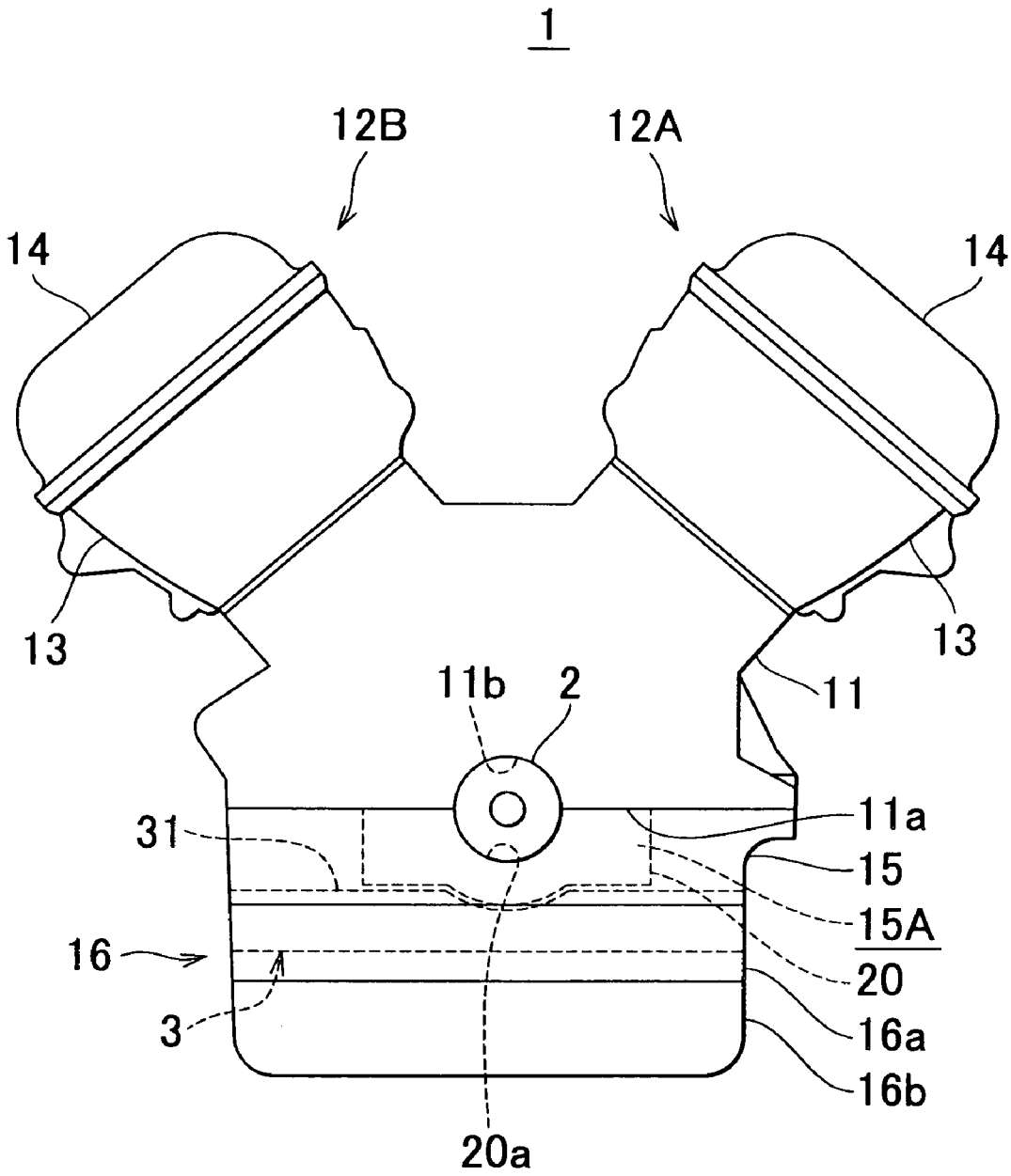
FIG. 4 is a rear view of the V-engine viewed from a rear side in the axial direction of the crankshaft.

As shown in FIG. 3, a baffle plate 3 having a substantially flat shape is provided in the pan 16. The baffle plate 3 prevents interference between the rotational members provided on or near the crankshaft 2 and the lubricant in the pan. The baffle plate 3 is bolted to predetermined positions of the inner peripheral surface of the upper pan 16*a*. As shown in FIG. 4, an extending portion 31 is provided at the rear end of the baffle plate 3. The extending portion 31 extends upward so that its upper end is close to the rearmost crank cap 20 in the rear side of the crankshaft 2 (the right in FIG. 1)., i.e., the side in the axial direction of the crank shaft that is opposite to the side where a larger amount of lubricant returns to the pan 16. The extending portion 31 is provided as close to the crank cap 20 as possible while avoiding interference with the bolt B. The extending portion 31 serves as preventing means for preventing piston pumping air generated above the baffle plate 3 from entering the space below the baffle plate 3 through the rear end of the baffle plate 3. As shown in FIG. 1, the rear end of the baffle plate 3 from which the extending portion 31 extends upward is located in the side opposite to where the timing chain 22 and the pump drive chain 24 are provided, that is, in the side where the deep depth portion 16B is provided. In the rear of the rearmost crank cap 20, lubricant flows along a rear wall of the crankcase 15 and returns to the pan 16.

As shown in FIG. 3, return holes 32 are formed on the baffle plate 3 so that lubricant which has dropped to the baffle plate 3 returns to the pan 16.

In the aforementioned embodiment, the crank cap 20 at the rearmost position in the axial direction of the crankshaft 2 is in the side that is opposite, in the axial direction of the crankshaft 2, to the side where a larger amount of lubricant returns to the pan 16, that is, the side where the deep depth portion 16B is provided. In the rear of this rearmost crank cap 20, lubricant flows along the rear wall of the crankcase 15 and returns to the pan 16. Further, the extending portion 31, which extends upward to be in the proximity of the rearmost crank cap 20 from the rear end of the baffle plate 3, prevents piston pumping air generated above the baffle plate 3 from entering the space below the baffle plate 3 through the rear end of the baffle plate 3. According to this construction, a large amount of lubricant returning from the front side of the crankshaft 2 to the pan 16 through the baffle plate 3 is prevented from colliding with piston pumping air entering the pan 16 from the rear side of the crankshaft 2 through the rear end of the baffle plate 3. As a result, lubricant can smoothly return to the pan.

Accordingly, since collisions between piston pumping air and lubricant can be effectively prevented as described above, it is possible to reduce the height of the shallow depth portion 16A and thus the overall height of the V-engine 1, which is significantly desirable and advantageous in view of the protection of pedestrians and arrangement of accessories, for example. Moreover, since piston pumping air can be prevented from entering the pan, lubricant is not stirred by piston pumping air. Accordingly, lubricant can be prevented from being deteriorated, and a temperature increase of lubricant can also be prevented. In addition, the amount of lubricant which is atomized due to collision with piston pumping air and then carried away by the piston pumping air is reduced.

It should be noted, however, that the invention is not limited to this embodiment and includes various modifications. For example, in the embodiment, the extending portion 31 provided at the rear end of the baffle plate 3 extends upward to be in the proximity of the rearmost crank cap 20. Namely, the crank cap 20 towards which the extending portion 31 extends upward is located in the side that is opposite, in the axial direction of the crankshaft 2, to the following: the side where a larger amount of lubricant returns to the pan; the side where the timing chain 22 for transmitting rotation of the crankshaft 2 to cam shafts and the pump drive chain 24 are provided; and the side where the shallow depth portion 16A of the pan 6 is provided. For example, a crank cap towards which the extending portion of the baffle plate extends upward may be defined as follows: a crank cap located at the end of the crankshaft in the side that is opposite, in the axial direction of the crankshaft, to the side where a larger amount of lubricant returns to the pan; a crank cap located at the end of the crankshaft in the side that is opposite, in the axial direction of the crankshaft, to where a chain that transmits rotation of the crankshaft is provided; and a crank cap located at the end of the crankshaft located in the side that is opposite, in the axial direction of the crankshaft, to where a shallow depth portion of the pan is provided.

Further, in the embodiment above, in the crank chamber 15A, the crankshaft 2 is rotatably supported between the concave portions 11*b* of the crank journal supports 11*a* of the cylinder block 11 and the concave portions 20*a* of the crank caps 20. However, a ladder frame having concave portions may be used in place of the crank caps and the pan may be fixed to the lower end of the cylinder block via the ladder frame, so that the crankshaft is rotatably supported between the concave portions of the crank journal supports and the concave portions of the ladder frame. In this case, preventing means for preventing piston pumping air generated above the baffle plate from entering the space below the baffle plate through the rear end of the baffle plate may be formed by sandwiching the end portion of the baffle plate between the ladder frame and the pan where they are joined.

For example, the end portion of the baffle plate to be sandwiched may be defined as follows: the end portion of the baffle plate located in the side that is opposite, in the axial direction of the crankshaft, to the side where a larger amount of lubricant returns to the pan; the end portion of the baffle plate located in the side that is opposite, in the axial direction of the crankshaft, to the side where the a chain for transmitting rotation of the crankshaft is provided; and the end portion of the baffle plate located in the side that is opposite, in the axial direction of the crankshaft, to the side where a shallow depth portion of the pan is provided.

Further, in the embodiment above, the baffle plate according to the invention is applied to the V-engine 1. However, the baffle plate may be applied to an in-line engine as well.

While the invention has been described with reference to exemplary embodiments thereof, it should be understood that the invention is not limited to the exemplary embodiments or constructions. To the contrary, the invention is intended to cover various modifications and equivalent arrangements. In addition, while the various elements of the exemplary embodiments are shown in various combinations and constructions, which are exemplary, other combinations and constructions, including more, less or only single element, are also within the spirit and scope of the invention.

What is claimed is:

1. A baffle plate configuration of an internal combustion engine, comprising:

a baffle plate that is provided below a rotational member arranged on or near a crankshaft and that prevents the rotational member and lubricant in a pan from interfering each other;

a preventing portion that is provided at a rear end portion of the baffle plate, the rear end portion of the baffle plate being located on a rear side of the baffle plate that is an opposite side of the baffle plate in the axial direction of the crankshaft to a front side of the baffle plate, the front side of the baffle plate including an oil return path that allows a larger amount of lubricant to return to the pan at the front side of the baffle plate than the rear side of the baffle plate, the preventing portion being arranged such that the preventing portion prevents piston pumping air generated above the baffle plate from entering a space below the baffle plate through the rear end portion of the baffle plate; and a chain that is provided on the crankshaft and that transmits rotation of the crankshaft, the chain being located in front of the front side of the baffle plate in the axial direction of the crankshaft such that the front side of the baffle plate is in closer proximity to the chain than the rear side of the baffle plate in the axial direction of the crankshaft.

2. The baffle plate configuration of an internal combustion engine according to claim 1, wherein:

the crankshaft is provided in a crankcase fixed to an upper end of the pan and is supported by a plurality of crank caps arranged in the axial direction of the crankshaft, and the preventing portion is an extending portion that extends from the rear end portion of the baffle plate to be in the proximity of one of the crank caps which is located in the crankcase on a rear side of the crankcase that is an opposite side of the crankcase in the axial direction of the crankshaft to a front side of the crankcase where a larger amount of lubricant returns to the pan than the rear side of the crankcase.

3. The baffle plate configuration of an internal combustion engine according to claim 1, wherein:

the crankshaft is provided in a crankcase fixed to an upper end of the pan and is supported by a plurality of crank caps arranged in the axial direction of the crankshaft, and the preventing portion is an extending portion that extends from the rear end portion of the baffle plate to be in the proximity of one of the crank caps which is located in the crankcase on a rear side of the crankcase that is an opposite side of the crankcase in the axial direction of the crankshaft to a front side of the crankcase that is in proximity to where the chain is provided.

4. The baffle plate configuration of an internal combustion engine according to claim 1, wherein:

the pan includes a shallow depth portion that is provided at a front side of the pan in an axial direction of the crankshaft and that includes a depth that is more shallow than a deep depth portion that is provided at a rear side of the pan, and the baffle plate is arranged above the pan such that the rear side of the baffle plate is located on a the opposite side of the baffle plate in the axial direction of the crankshaft to the front side of the baffle plate such that the front side of the baffle plate is located directly above where the shallow depth portion of the pan is provided.

5. The baffle plate configuration of an internal combustion engine according to claim 4, wherein:

the crankshaft is provided in a crankcase fixed to an upper end of the pan and is supported by a plurality of crank caps arranged in the axial direction of the crankshaft, and the preventing portion is an extending portion that extends from the rear end portion of the baffle plate to be in the proximity of one of the crank caps which is located in the crankcase on a rear side of the crankcase that is an opposite side of the crankcase in the axial direction of the crankshaft to a front side of the crankcase in proximity to where the shallow depth portion is provided.

6. The baffle plate configuration of an internal combustion engine according to claim 1, wherein:

the baffle plate is arranged such that a rear end portion of the baffle plate is located in proximity to a rear side of the internal combustion engine that is an opposite side of the internal combustion engine in the axial direction of the crankshaft to a front side of the internal combustion engine that is in proximity to where the crankshaft protrudes from a crankcase that houses the rotational member.

7. The baffle plate configuration of an internal combustion engine according to claim 6, wherein:

an amount of lubricant that returns to the pan in proximity to a front side of the crankcase where the crankshaft protrudes from the crankcase is larger than an amount of lubricant that returns to the pan in proximity to a rear side of the crankcase that is an opposite side of the crankcase in the axial direction of the crankshaft to the front side of the crankcase where the crankshaft protrudes from the crankcase.

8. The baffle plate configuration of an internal combustion engine according to claim 7, wherein:

the crankshaft is provided in the crankcase fixed to an upper end of the pan and is supported by a plurality of crank caps arranged in the axial direction of the crankshaft, and the preventing portion is an extending portion that extends from the rear end portion of the baffle plate to be in the proximity of one of the crank caps which is located in the crankcase on the rear side of the crankcase that is the opposite side of the crankcase in the axial direction of the crankshaft to the front side of the crankcase where the crankshaft protrudes from the crankcase.

9. The baffle plate configuration of an internal combustion engine according to claim 6, wherein:

the chain that transmits rotation of the crankshaft is provided in proximity to a front side of the crankcase where the crankshaft protrudes from the crankcase.

10. The baffle plate configuration of an internal combustion engine according to claim 9, wherein:

the crankshaft is provided in the crankcase fixed to an upper end of the pan and is supported by a plurality of crank caps arranged in the axial direction of the crankshaft, and the preventing portion is an extending portion that extends from the rear end portion of the baffle plate to be in the proximity of one of the crank caps which is located in the crankcase on a rear side of the crankcase that is where the preventing portion is provided.

11. The baffle plate configuration of an internal combustion engine according to claim 6, wherein:

a shallow depth portion of the pan is provided at a front side of the pan in proximity to where the crankshaft protrudes from the crankcase, the shallow depth portion having depth that is more shallow than a deep depth portion that is provided at a rear side of the pan.

12. The baffle plate configuration of an internal combustion engine according to claim 11, wherein:

the crankshaft is provided in the crankcase, is fixed to an upper end of the pan, and is supported by a plurality of crank caps arranged in the axial direction of the crankshaft, and the preventing portion is an extending portion that extends from the rear end portion of the baffle plate to be in the proximity of one of the crank caps which is located in the crankcase on a rear side of the crankcase that is where the preventing portion is provided.

13. The baffle plate configuration of an internal combustion engine according to claim 1, wherein the pan includes an upper pan and a lower pan and the baffle plate is at attached to an inner peripheral surface of the upper pan.

14. The baffle plate configuration of an internal combustion engine according to claim 1, wherein:

the crankshaft is provided in a crankcase fixed to an upper end of the pan and is supported by a plurality of crank caps arranged in the axial direction of the crankshaft, and the preventing portion is a rear wall of the baffle plate that extends in a vertical direction from the rear end portion of the baffle plate to a position in close proximity to a rearmost one of the crank caps with respect to the axial direction of the crankshaft.

15. The baffle plate configuration of an internal combustion engine according to claim 1, wherein the baffle plate includes a front wall that extends in a vertical direction from a front end portion of the baffle plate, the front end portion of the baffle plate being located on the front side of the baffle plate opposite to the rear side of the baffle plate in the axial direction of the crankshaft, and wherein the front wall allows piston pumping air generated above the baffle plate to enter a space below the baffle plate through the front end portion of the baffle plate.

16. The baffle plate configuration of an internal combustion engine according to claim 15, wherein:

the baffle plate includes a front wall that extends in a vertical direction from a front end portion of the baffle plate, the front end portion of the baffle plate being located on the front side of the baffle plate opposite to the rear side of the baffle plate in the axial direction of the crankshaft, and the front wall is shorter than the rear wall.

17. The baffle plate configuration of an internal combustion engine according to claim 16, wherein:

the crankshaft is provided in a crankcase fixed to an upper end of the pan and is supported by a plurality of crank caps arranged in the axial direction of the crankshaft, and the oil return path is located between the front wall and a vertical wall of the pan forward of the baffle plate in the axial direction of the crankshaft.

18. The baffle plate configuration of an internal combustion engine according to claim 14, wherein the rear wall is not in direct contact with any of the crank caps.

19. The baffle plate configuration of an internal combustion engine according to claim 1, wherein the oil return path is located directly below the chain.

* * * * *